US006688801B2

(12) United States Patent
Husson

(10) Patent No.: US 6,688,801 B2
(45) Date of Patent: Feb. 10, 2004

(54) QUICK FASTENING SAFETY DEVICE FOR FIXING A TOOL TO THE END OF A LOADER ARM OR THE LIKE

(75) Inventor: Alain Husson, Orléans (FR)

(73) Assignee: Klac Industrie, Olivet (FR)

( * ) Notice: Subject to any disclaimer, the term of this patent is extended or adjusted under 35 U.S.C. 154(b) by 0 days.

(21) Appl. No.: 10/275,260

(22) PCT Filed: May 14, 2001

(86) PCT No.: PCT/FR01/01443

§ 371 (c)(1),
(2), (4) Date: Nov. 8, 2002

(87) PCT Pub. No.: WO01/92648

PCT Pub. Date: Dec. 6, 2001

(65) Prior Publication Data

US 2003/0113159 A1 Jun. 19, 2003

(30) Foreign Application Priority Data

May 31, 2000 (FR) ..... 00 06972

(51) Int. Cl.[7] ..... B25G 3/18

(52) U.S. Cl. ..... 403/322.1; 403/322.3; 403/325; 414/723; 37/468

(58) Field of Search ..... 403/321, 322.1, 403/322.2, 322.3, 322.4, 325; 414/723; 37/468

(56) References Cited

U.S. PATENT DOCUMENTS

| | | | | |
|---|---|---|---|---|
| 3,934,738 | A | * 1/1976 | Arnold | |
| 4,436,477 | A | * 3/1984 | Lenertz et al. | |
| 4,480,955 | A | * 11/1984 | Andrews et al. | |
| 4,632,595 | A | * 12/1986 | Schaeff | 403/322.3 X |
| 4,836,741 | A | * 6/1989 | St. Louis et al. | |
| 5,082,389 | A | * 1/1992 | Balemi | |
| 5,147,173 | A | * 9/1992 | Fauber et al. | |
| 5,224,816 | A | * 7/1993 | Kaczmarczyk et al. | |
| 5,597,283 | A | * 1/1997 | Jones | |
| 5,974,706 | A | * 11/1999 | Kaczmarski et al. | |
| 6,350,079 | B1 | * 2/2002 | Williams | 403/322.1 X |
| 6,487,800 | B1 | * 12/2002 | Evans et al. | 403/322.1 X |

FOREIGN PATENT DOCUMENTS

| | | | |
|---|---|---|---|
| EP | 0143074 | * | 5/1985 |
| EP | 0438931 | * | 7/1991 |
| EP | 0521560 | * | 1/1993 |
| EP | 0542120 | * | 5/1993 |
| EP | 0594486 | | 4/1994 |
| EP | 2703113 | * | 9/1994 |
| FR | 2641343 | * | 7/1990 |
| FR | 2703113 | | 9/1994 |
| FR | 2765601 | | 1/1999 |
| FR | 2785952 | | 5/2000 |
| GB | 2267887 | * | 12/1993 |
| WO | 98/46835 | | 10/1998 |

OTHER PUBLICATIONS

English Language Abstract of EP 0 438 931.*
English Language Abstract of EP 0 521 560.*
English Language Abstract of EP 2 703 113.*
English Language Abstract of EP 0 143 074.*
English Language Abstract of UK 2 267 887.*
English Language Abstract of EP 0 542 120.*
English Language Abstract of EP 2 641 343.*

* cited by examiner

*Primary Examiner*—Lynne H. Browne
*Assistant Examiner*—John Cottingham
(74) *Attorney, Agent, or Firm*—Greenblum & Bernstein, P.L.C.

(57) ABSTRACT

Quick fastener system for fixing a tool at the end of a loading arm, wherein the system includes a first part configured to be coupled to the loading arm. The first part includes a cradle and a first aperture. A second part is configured to be coupled to the tool. The second part includes a hook-shaped extension and a shaft which is adapted to be engaged by the cradle. A locking plate is adapted to engage the hook-shaped extension after the hook-shaped extension passes through the first aperture. At least one spring is coupled to the locking plate. The hook-shaped extension includes at least one lateral projection

22 Claims, 4 Drawing Sheets

PRIOR ART

PRIOR ART

QUICK FASTENING SAFETY DEVICE FOR FIXING A TOOL TO THE END OF A LOADER ARM OR THE LIKE

CROSS-REFERENCE TO RELATED APPLICATIONS

The present application is a National Stage Application of International Application No. PCT/FR01/01443, filed May 14, 2001. Further, the present application claims priority under 35 U.S.C. §119 of French Patent Application No. 00 06972 filed on May 31, 2000.

BACKGROUND OF THE INVENTION

1. Field of the Invention

The present invention relates to a quick fastening safety device adapted for fixing a tool to the end of a loader arm or the like.

2. Discussion of Background Information

The state of the art is constituted, among other things, by the fastening described in the published French Patent Application No. 2785952.

In this document, a fastening in two parts is described, comprising a fastening member provided with a cradle allowing to straddle a shaft that is affixed to the other part, one of the parts comprising an opening that can be traversed by a hooked-shaped extension under which a slidable locking plate can be inserted, allowing to maintain one pressed against the other, both elements constituting the fastening.

The locking plate is maintained in a loaded position, and in this position, it does not oppose the passage of the hook-shaped extension through the aforementioned opening. It is during this passage that the aforementioned extension releases the locking plate that, under the action of springs that are released, is inserted under the hook in order to lock the two fastening parts together.

The hook and the plate have oblique surfaces that cooperate and press the two fastening parts together.

If, for any reason, such as the presence of dirt, for example, the locking plate does not extend completely under the corresponding portion of the hook, the aforementioned cooperation is incomplete, and under impacts and vibrations, one can fear a risk of unhooking along with all of the drawbacks that that can have.

SUMMARY OF THE INVENTION

The present invention, which overcomes this drawback, is characterized in that the hook has a mechanism that is capable of cooperating with the locking plate to oppose the rotation of the fastening part comprising the hook.

The invention also provides for a quick fastener system for fixing a tool at the end of a loading arm, wherein the system comprises a first part configured to be coupled to the loading arm. The first part comprises a cradle and a first aperture. A second part is configured to be coupled to the tool. The second part comprises a hook-shaped extension and a shaft which is adapted to be engaged by the cradle. A locking plate is adapted to engage the hook-shaped extension after the hook-shaped extension passes through the first aperture. At least one spring is coupled to the locking plate. The hook-shaped extension comprises at least one lateral projection.

The second part may be immobilized with respect to the first part when the cradle engages the shaft and when the locking member engages the hook-shaped extension. The first part may comprise a catching member which has substantially the shape of a bracket. The first aperture may be disposed in a median portion of the first part and the locking plate may be disposed between the median portion and the hook-shaped extension. The second part may be coupled to the tool. The locking plate may be biased to engage the hook-shaped extension.

The system may further comprise a guide mechanism for guiding the locking plate, wherein the locking plate is constantly subject to a force that tends to move the locking plate towards the shaft. The system may further comprise a second aperture disposed in the locking plate, wherein the second aperture is adapted to be aligned with the first aperture when the tool is mounted to the loading arm. The system may further comprise a finger adapted to engage the locking plate, wherein the finger is one of movably mounted and pivotally mounted to the first part. The finger may comprise a shoulder which is adapted to engage the locking plate in order to maintain the locking plate in a fixed position. The finger may comprise an extended portion which is adapted to be engaged by the hook-shaped extension.

The first part may comprise an abutment which is adapted to engage the locking plate. The abutment may be disposed on a finger that is movably mounted to the first part, and wherein the abutment maintains the locking plate in an armed position against a force which acts to bias the locking plate towards the hook-shaped extension. The abutment may comprise a shoulder which is adapted to engage the locking plate. Each of the first part and the second part may comprise engaging surfaces which are adapted to immobilize the tool with respect to the first part. The engaging surfaces may be angled. The at least one lateral projection may comprise at least two lateral projections. The first aperture may include a recess that is configured to receive the at least one lateral projection. The system may further comprise a second aperture disposed in the locking plate, wherein the second aperture is adapted to be aligned with the first aperture when the tool is mounted to the loading arm. The second aperture may include a recess that is configured to receive the at least one lateral projection.

The invention also provides for a quick fastener system for fixing a tool at the end of a loading arm, wherein the system comprises a first part configured to be coupled to the loading arm. The first part comprises a cradle and a first aperture. A second part is configured to be coupled to the tool. The second part comprises a hook-shaped extension and a shaft which is adapted to be engaged by the cradle. A movable locking plate comprises a second aperture. The locking plate is configured to engage the hook-shaped extension after the hook-shaped extension passes through the first aperture and the second aperture. At least one spring is coupled to the locking plate. The hook-shaped extension comprises at least one lateral projection.

The invention also provides for a quick fastener system for fixing a tool at the end of a loading arm, wherein the system comprises a first part configured to be coupled to the loading arm. The first part comprises a cradle and a first aperture having a recess. A second part is configured to be coupled to the tool. The second part comprises a hook-shaped extension and a shaft which is adapted to be engaged by the cradle. A movable locking plate comprises a second aperture having a recess. The locking plate is configured to engage the hook-shaped extension after the hook-shaped extension passes through the first aperture and the second aperture. At least one spring is coupled to the locking plate. The hook-shaped extension comprises at least one lateral projection, and the recesses of the first and second apertures are configured to receive the at least one lateral projection.

BRIEF DESCRIPTION OF THE DRAWINGS

The present invention will be better understood from the following description, with reference to the attached drawings that are given only by way of example, and in which.

DETAILED DESCRIPTION OF THE INVENTION

Figure 1:
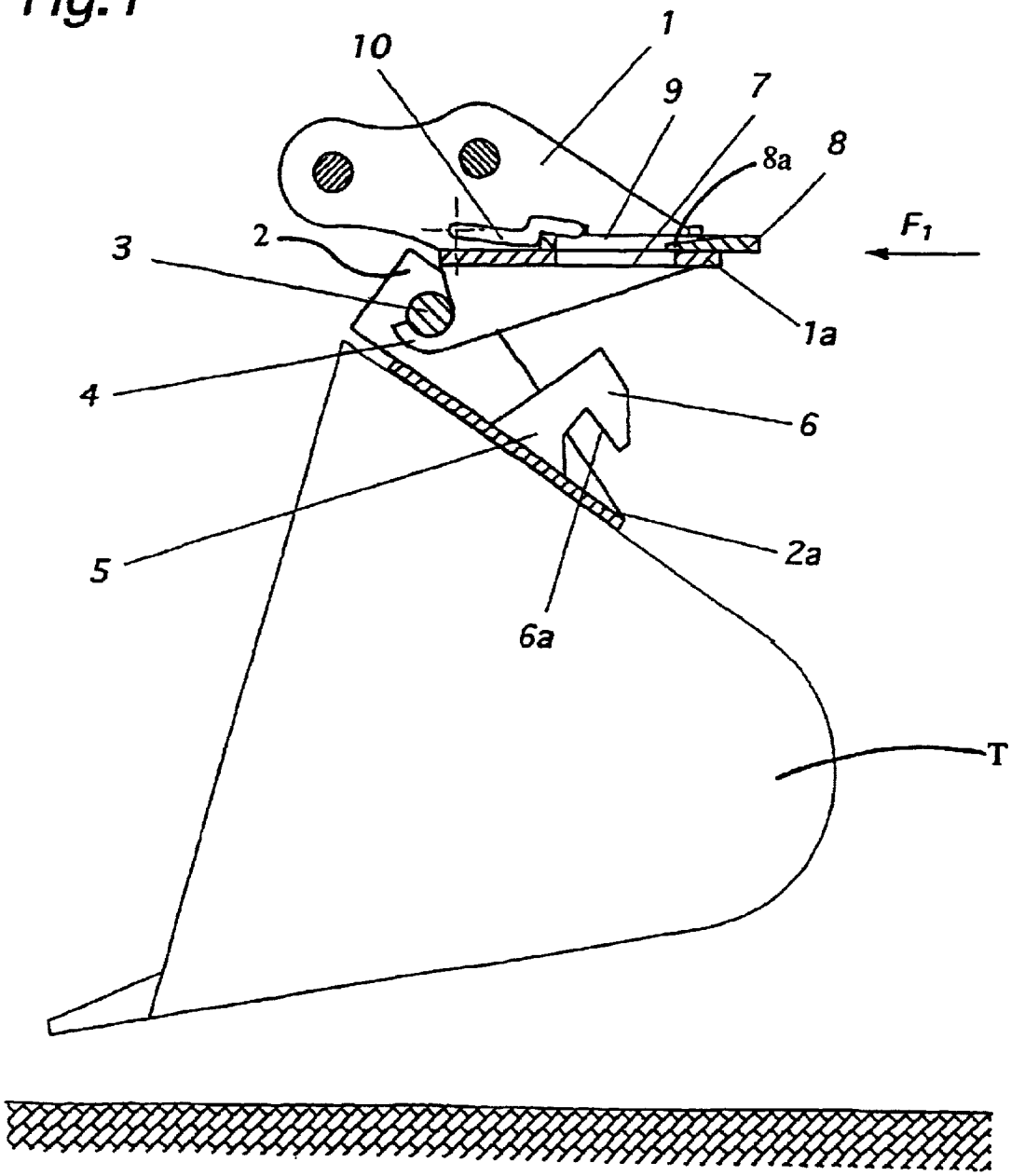
FIG. 1 is a view of a quick fastening of a known type.

In referring to FIG. 1, one can see that the fastening, which is consistent with the one described in the published French Patent Application No. 2785952, comprises two parts 1 and 2, both having substantially the shape of a bracket.

One of the parts comprises a shaft 3 that can be gripped by a craddle 4 from the other part.

The part 2 has on its median portion 2*a* an extension 5 forming a hook 6. The extension 5 can pass through an opening 7 provided on the median portion 1*a* of the part 1.

A locking plate 8, having an opening 9 for the passage of the extension 5, can slide on the part 1.

In FIG. 1, the plate 8 is represented in the loaded position, the openings 7 and 9 being substantially aligned. The plate 8 is maintained in this position, for example, by way of a pivoting locking finger 10.

During rotation about the axis of the shaft 3, the extension 5 pushes back the finger 10, and the plate 8 is displaced along the arrow F1 under the effect of common return springs.

If nothing opposes the displacement, for example, the presence of dirt, the oblique edge 8*a* of the plate 8 is inserted under the portion 6*a* of the hook 6, the cooperation of the oblique portions in contact having the effect of pressing the two parts of the fastening together.

Figure 2:
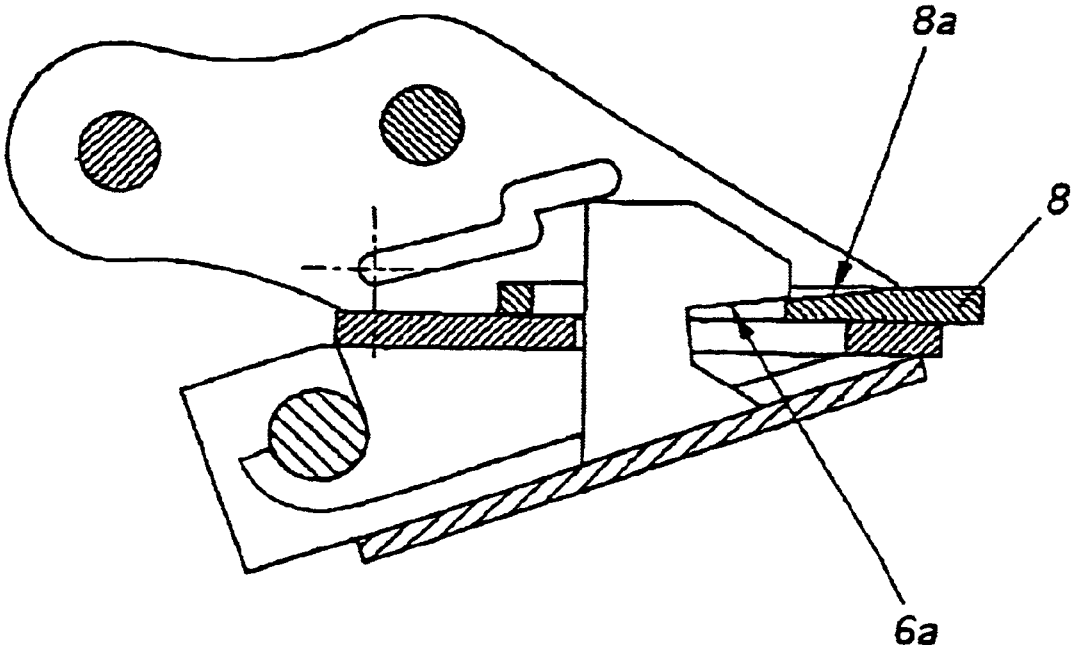
FIG. 2 is a view, on a larger scale than FIG. 1, showing the position of the locking plate when an incident occurs.

If the surfaces that are to cooperate are more or less embedded in the dirt, the plate 8, under the action of the springs, which are then substantially stretched, will move along the arrow F1 but will not be completely inserted under the hook 6, giving the illusion of a locking which in fact did not occur. It is this type of incident that is represented in FIG. 2.

In this FIG., one notes that the surfaces 8*a* and 6*a* are not fully or completely applied together. As a result, when working, the impacts and vibrations can cause the unhooking and dropping of the tool T connected to the arm of the apparatus.

The present invention, which overcomes this drawback, provides for a safety device that opposes the pivoting of the part 2 comprising the hook 6 as soon as it has passed through the openings 7 and 9.

According to one embodiment, the extension 5 has, at its upper portion, at least one lateral finger 11, the openings 7 and 9 having recesses 12 and 13 allowing the passage of the finger 11.

Figure 3:
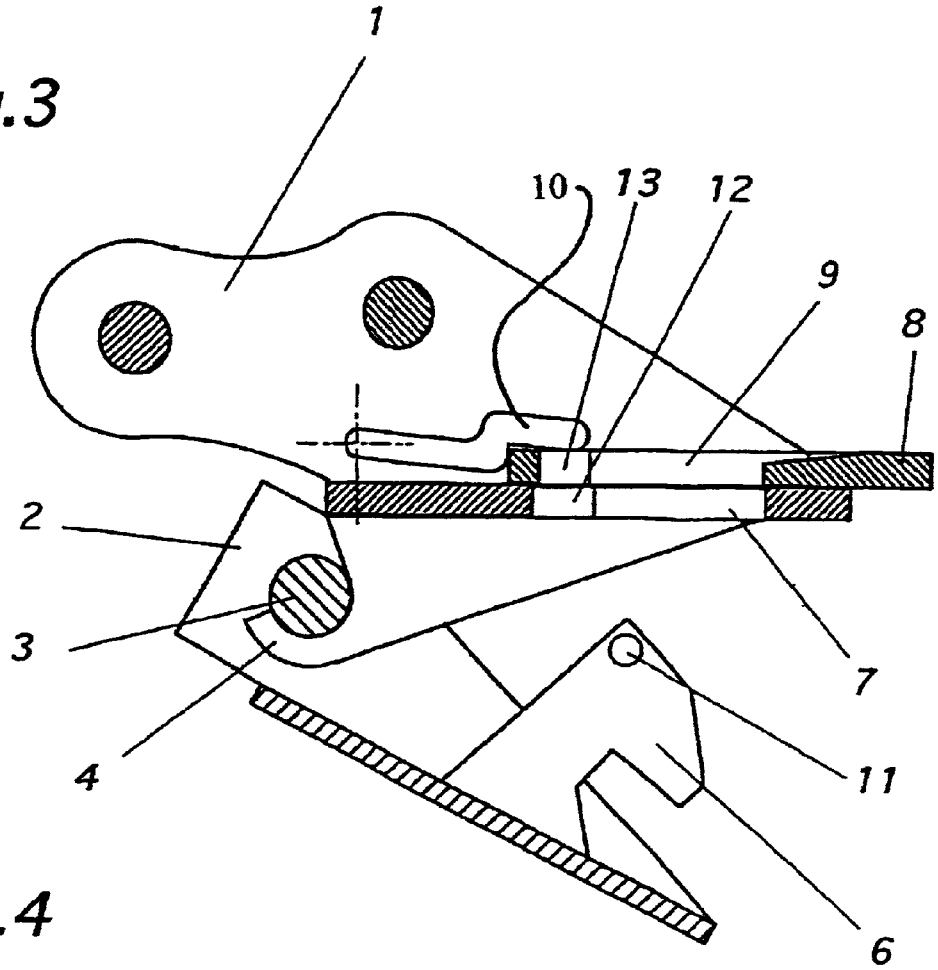
FIG. 3 is a view similar to FIG. 1, showing a modified fastening according to the invention.
Figure 4:
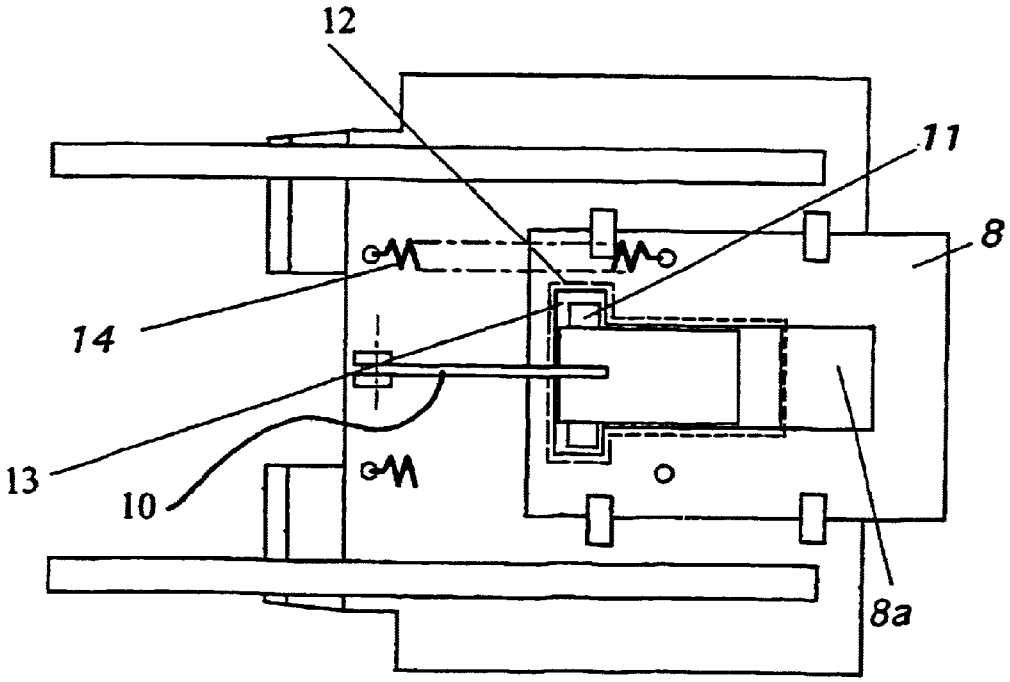
FIG. 4 is the top view of FIG. 3.
Figure 5:
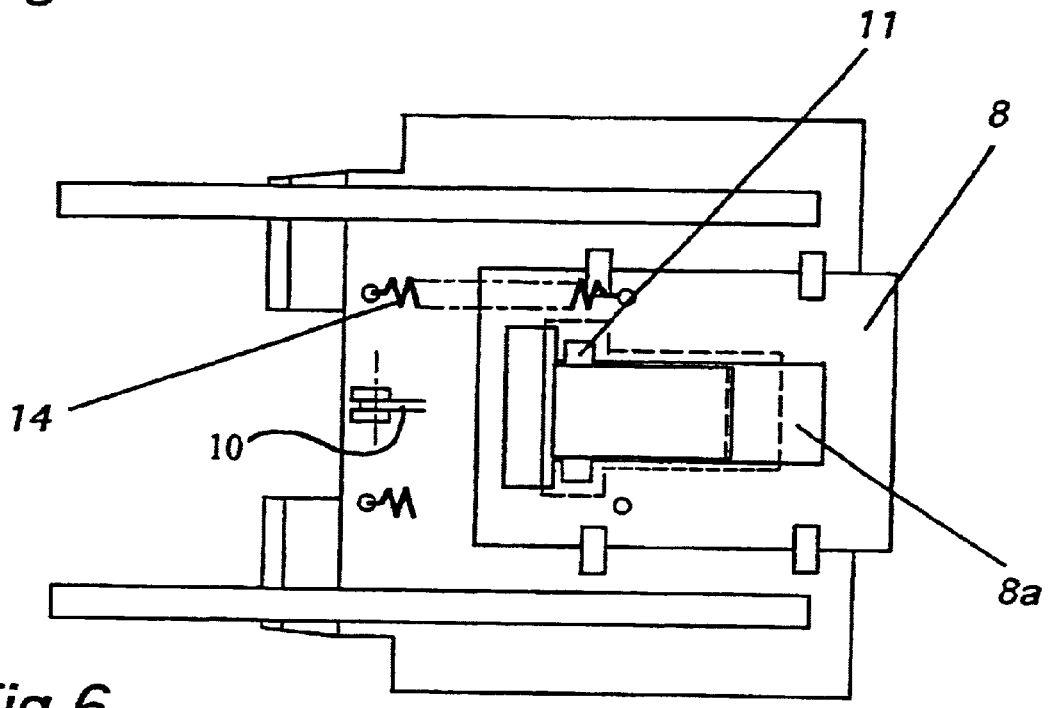
FIG. 5 is a view, similar to FIG. 4, showing the fastening in a safety position.

When the plate 8 is in the loaded position, the common return springs 14 being stretched, the recesses 12 and 13 are aligned (FIGS. 3 and 4).

Figure 6:
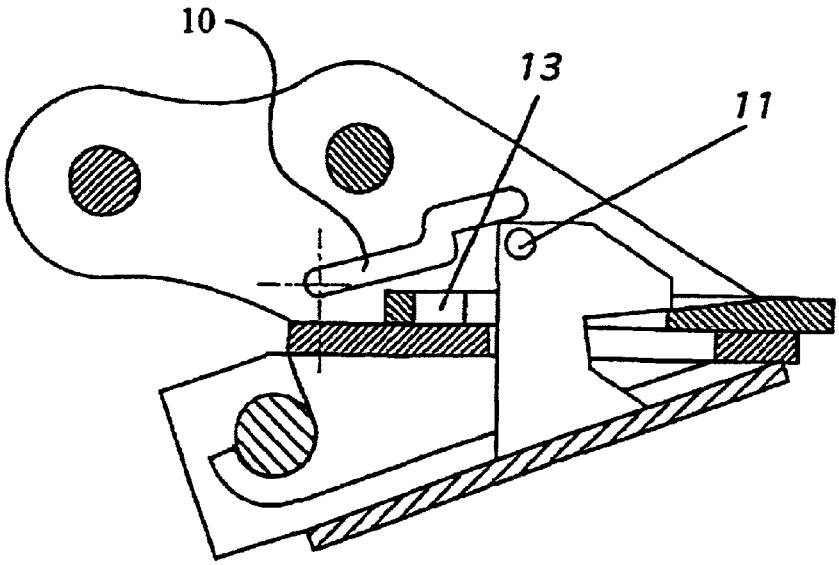
FIG. 6 is the front view of FIG. 5.

At the end of the movement, in order to go from the position shown in FIG. 4 to the one shown in FIG. 6, the extension 5 pushes back the finger 10, and the fingers 11 are located above the plane of the plate 8, which is displaced along the arrow F1.

The same type of incident shown in FIG. 2 is shown in FIG. 6: the contact between the surfaces 6*a* and 8*a* is very imperfect, for example, dirt preventing the plate 8 from being inserted completely under the hook 6.

If the contact between the two aforementioned surfaces 6*a* and 8*a* is broken, the part 2 of the fastening will pivot slightly until the fingers 11 take support against the plate 8 by opposing the unhooking and dropping of the tool T connected to the part 2.

What is claimed is:

1. A quick fastener system for fixing a tool at the end of a loading arm, the system comprising:

a first part configured to be coupled to the loading arm;

the first part comprising a cradle and a first aperture having a recess;

a second part configured to be coupled to the tool;

the second part comprising a hook-shaped extension and a shaft which is adapted to be engaged by the cradle;

a movable locking plate comprising a second aperture having a recess;

the locking plate being configured to engage the hook-shaped extension after the hook-shaped extension passes through the first aperture and the second aperture; and at least one spring coupled to the locking plate, wherein the hook-shaped extension comprises at least one lateral projection, and wherein the recesses of the first and second apertures are configured to receive the at least one lateral projection.

2. A quick fastener system for fixing a tool at the end of a leading arm, the system a first part configured to be coupled to the loading arm;

the first part comprising a cradle and a first aperture;

a second part configured to be coupled to the tool;

the second part comprising a hook-shaped extension and a shaft which is adapted to be engaged by the cradle;

a movable locking plate comprising a second aperture;

the locking plate being configured to engage the hook-shaped extension after the hook-shaped extension passes through the first aperture and the second aperture; and at least one spring coupled to the locking plate, wherein the hook-shaped extension comprises at least one lateral projection.

3. A quick fastener system for fixing a tool at the end of a loading arm, the system comprising:

a first part configured to be coupled to the loading arm;

the first part comprising a cradle and a first aperture;

a second part configured to be coupled to the tool;

the second part comprising a hook-shaped extension and a shaft which is adapted to be engaged by the cradle;

a locking plate adapted to engage the hook-shaped extension after the hook-shaped extension passes through the first aperture; and at least one spring coupled to the locking plate, wherein the hook-shaped extension comprises at least one lateral projection.

4. The system of claim 3, wherein the second part is immobilized with respect to the first part when the cradle engages the shaft and when the locking member engages the hook-shaped extension.

5. The system of claim 3, wherein the first part comprises a catching member which has substantially the shape of a bracket.

6. The system of claim 3, wherein the first aperture is disposed in a median portion of the first part and wherein the locking plate is disposed between the median portion and the hook-shaped extension.

7. The system of claim 3, wherein the second part is coupled to the tool.

8. The system of claim 3, wherein the locking plate is biased to engage the hook-shaped extension.

9. The system of claim 3, further comprising a guide mechanism for guiding the locking plate, wherein the locking plate is constantly subject to a force that tends to move the locking plate towards the shaft.

10. The system of claim 3, further comprising a second aperture disposed in the locking plate, wherein the second aperture is adapted to be aligned with the first aperture when the tool is mounted to the loading arm.

11. The system of claim 3, further comprising a finger adapted to engage the locking plate, wherein the finger is one of movably mounted and pivotally mounted to the first part.

12. The system of claim 11, wherein the finger comprises a shoulder which is adapted to engage the locking plate in order to maintain the locking plate in a fixed position.

13. The system of claim 12, wherein the finger comprises an extended portion which is adapted to be engaged by the hook-shaped extension.

14. The system of claim 3, wherein the first part comprises an abutment which is adapted to engage the locking plate.

15. The system of claim 14, wherein the abutment is disposed on a finger that is movably mounted to the first part, and wherein the abutment maintains the locking plate in an armed position against a force which acts to vias the locking plate towards the hook-shaped extension.

16. The system of claim 15, wherein the abutment comprises a shoulder which is adapted to engage the locking plate.

17. The system of claim 3, wherein each of the first part and the second part comprises engaging surfaces which are adapted to immobilize the tool with respect to the first part.

18. The system of claim 17, wherein the engaging surfaces are angled.

19. The system of claim 3, wherein the at least one lateral projection comprises at least two lateral projections.

20. The system of claim 3, wherein the first aperture includes a recess that is configured to receive the at least one lateral projection.

21. The system of claim 20, further comprising a second aperture disposed in the locking plate, wherein the second aperture is adapted to be aligned with the first aperture when the tool is mounted to the loading arm.

22. The system of claim 21, wherein the second aperture includes a recess that is configured to receive the at least one lateral projection.

* * * * *